United States Patent [19]

Russell et al.

[11] 4,159,661

[45] Jul. 3, 1979

[54] ROTARY CUTTER

[75] Inventors: Alfred G. Russell, Lebannon; Michael W. Schwetz, Warren, both of N.J.

[73] Assignee: Egan Machinery Company, Somerville, N.J.

[21] Appl. No.: 812,658

[22] Filed: Jul. 5, 1977

[51] Int. Cl.[2] ..... B26D 1/38; B26D 1/56

[52] U.S. Cl. ..... 83/305; 83/349; 83/341

[58] Field of Search ..... 83/305, 304, 349, 342, 83/341, 564, 551, 525

[56] References Cited

U.S. PATENT DOCUMENTS

| | | | |
|---|---|---|---|
| 151,668 | 6/1874 | Newman | 83/305 |
| 3,296,909 | 1/1967 | Hudak et al. | 83/305 |
| 3,522,751 | 8/1970 | Waldura | 83/304 |
| 3,750,510 | 8/1973 | Gabriels | 83/305 |

*Primary Examiner*—Donald R. Schran
*Attorney, Agent, or Firm*—Edward R. Weingram

[57] ABSTRACT

A rotary cutter in which a bed knife is displacably mounted with relation to the rotary knife so that the bed knife, when actuated, travels a path between an operative position adjacent the rotary knife and an inoperative position remote from the rotary knife. An extendable linkage connected to the bed knife defines the operative position of the bed knife at the point of maximum linkage extension. Adjusting means connected with the linkage enable precise determination of maximum linkage extension which thereby insures precise setting of the bed knife and prevents bed knife travel beyond the operative position.

10 Claims, 2 Drawing Figures

ROTARY CUTTER

BACKGROUND OF THE INVENTION

1. Field of the Invention

This invention relates to rotary cutters used for cutting paper and other web materials into predetermined sheet lengths and in particular to apparatus for controlling the distance and position of one knife of a cutter relative to the other knife.

2. Description of the Prior Art

This invention relates to rotary cutters which cut a traveling web of material into predetermined sheet lengths by the coaction of a rotating knife with a bed knife that is stationary at the time of cutting. The bed knife is positioned at an angle to the direction of web travel and the rotating knife is helically shaped so that a progressive transverse square cut is made in the web.

In the simpler types of cutters the length of the cut sheet is determined by the speed of the rotating knife relative to the speed of the traveling web. To cut sheets of long length the speed of the rotating knife must be so low, that the peripheral speed of the rotating knife is less than the web speed. Therefore, during the progressive cut across the web width, the web buckles or humps between the cutter feeding means and the knives.

This buckling or humping phenomenon does not normally offer any serious problems when cutting flexible, non-brittle webs. However, certain types of web material can be satisfactorily cut only if the peripheral speed of the rotary knife is equal to or greater than the web speed. An example of these types of web materials are the impregnated papers used to make high pressure laminates, such as kraft papers impregnated with phenolic resins and heavy alpha stock papers impregnated with melamine resins. These web materials when impregnated and dried are brittle and tend to break or shatter between the infeed and the knives if the peripheral speed of the rotary knife is less than the web speed.

To overcome this problem, "miss-cut" or "skip-cut" rotary cutters have been developed which provide for cutting action to take place every second, third, fourth, etc., revolution of the rotary knife thus allowing long sheet lengths to be cut with a relatively small diameter high speed rotary knife so that the peripheral speed of the knife is equal to or greater than the web speed at all times. One such rotary cutter is disclosed in U.S. Pat. No. 3,136,194 where the rotary knife can be moved into and out of engagement with a fixed bed knife. Another type of cutter provides a rotary knife on a fixed axis and a bed knife which is moved into and out of engagement with the rotary knife.

The normal rotary cutter has one knife made of hardened steel and the other of soft or mild steel. The latter can easily be warped and dressed into position in relation to the hardened knife and any accidental contact between the knives is of little consequence. However, since many brittle web materials are abrasive it is necessary that both knives be made of hardened steel to prevent the unacceptable, rapid wear that would occur on a soft blade. However, any contact between two hardened knives results in nicks in the blades resulting in loss of cutting action and requiring that the knives be removed and reground. Since the actual clearance between blades when cutting may be as little as 0.0005 inch, it can be seen that the means for adjusting and maintaining this clearance between blades must be very precise.

Further, it has been found that different thicknesses of materials require different knife clearances to minimize difficulties during cutting. It has been found, for example, that clearances of 0.0005 to 0.001 inches are optimum for the thinnest materials and that clearances up to 0.005 are optimum for the thicker materials. Inasmuch as all ranges of material thicknesses may be normally cut on the same machine, it is necessary that a clearance adjustment means be provided which can be controlled by the machine operator to suit the particular material to be cut. Not only must the adjusting means provide repeatability without backlash, the adjusting means also must be so designed that at no time can the operator accidently adjust the knives so that they come into contact.

It is also desirable that normal wear in the knife adjusting means does not decrease the clearance between the knives and thereby possibly cause contact between the knives.

SUMMARY OF THE INVENTION

To overcome the problems of the prior act, the present invention sets forth a rotary cutter in which a bed knife is displacably mounted with relation to the rotary knife so that the bed knife, when actuated, travels a path between an operative position adjacent the rotary knife and an inoperative position remote from the rotary knife. An extendable linkage connected to the bed knife defines the operative position of the bed knife at the point of maximum linkage extension. Adjusting means connected with the linkage enable precise determination of maximum linkage extension which thereby insures precise setting of the bed knife and prevents bed knife travel beyond the operative position.

Accordingly, it is an object of the present invention to provide a rotary cutter having knives which can be adjusted over a wide range during operation of the apparatus.

It is another object of the present invention to provide a rotary cutter having knives which can be adjusted with relative ease and without having to shut down the apparatus.

Yet another object of the present invention is to provide a rotary cutter having knives which can be adjusted over a wide range without contact occurring between the knives.

A further object of the present invention is to provide a rotary cutter having knives which can be adjusted with relatively high precision and repeatability.

Still another object of the present invention is to provide a rotary cutter having means for adjusting the knives of the apparatus which adjusting means will not decrease the clearance of the knives during normal wear of the adjusting means.

It is another object of the present invention to provide a rotary cutter having knives which can be adjusted at the cutting position of the apparatus.

Yet another object of the present invention is to provide a rotary cutter having means for adjusting the knives which is relatively reliable and will not allow the setting of the knives to vary during normal operation of the apparatus.

Still a further object of the present invention is to provide a rotary cutter having means for adjusting the knives which will produce relatively little change in the setting of the knives in relation to relatively substantial wear of the adjusting means.

Other objects and advantages will be apparent from the following description of the preferred embodiment of the invention, and the novel features will be particularly pointed out hereinafter in connection with the appended claims.

DESCRIPTION OF THE PREFERRED EMBODIMENT

Figure 1:
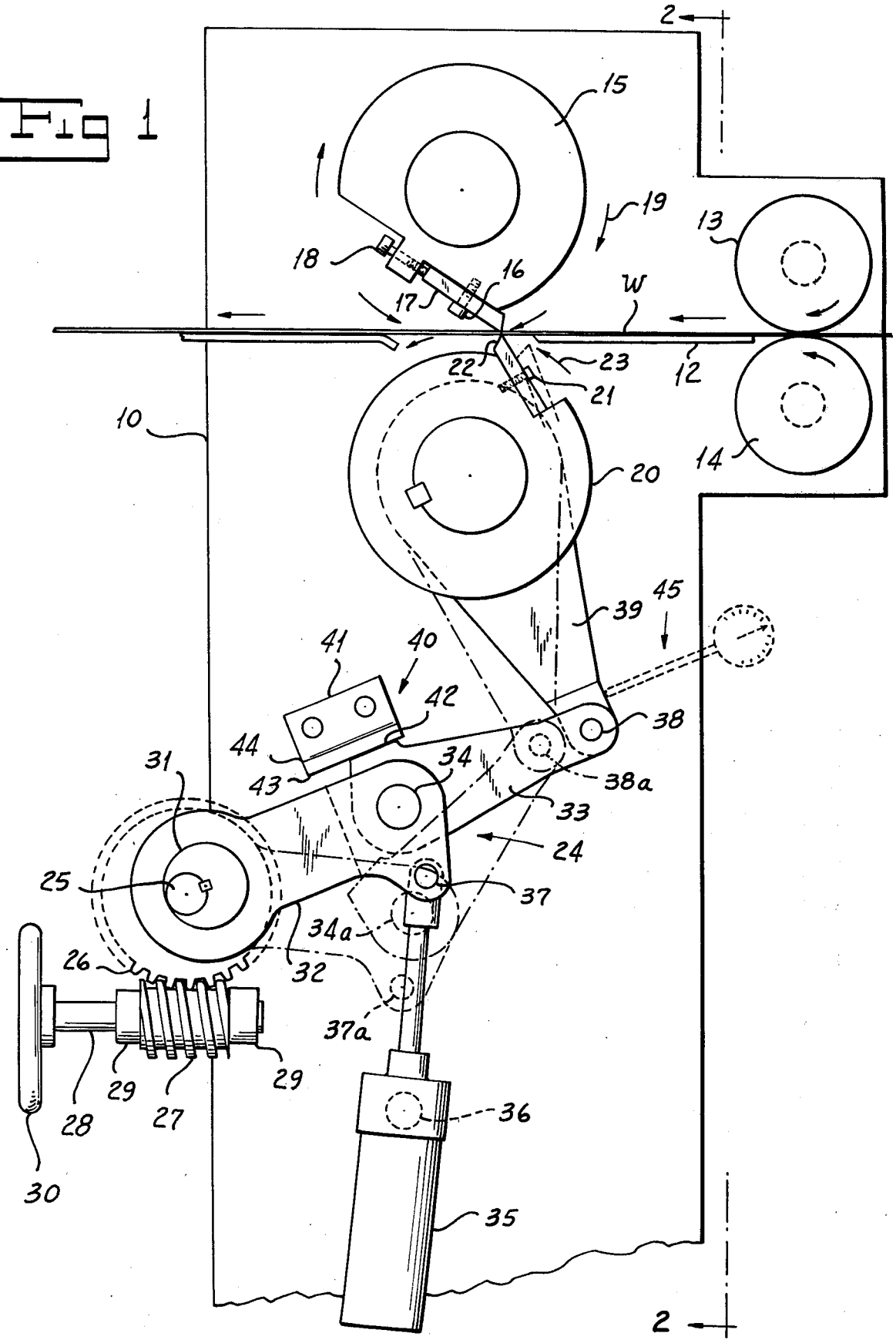
FIG. 1 is a side elevation of a portion of a rotary cutter built in accordance with the teachings of the present invention.
Figure 2:
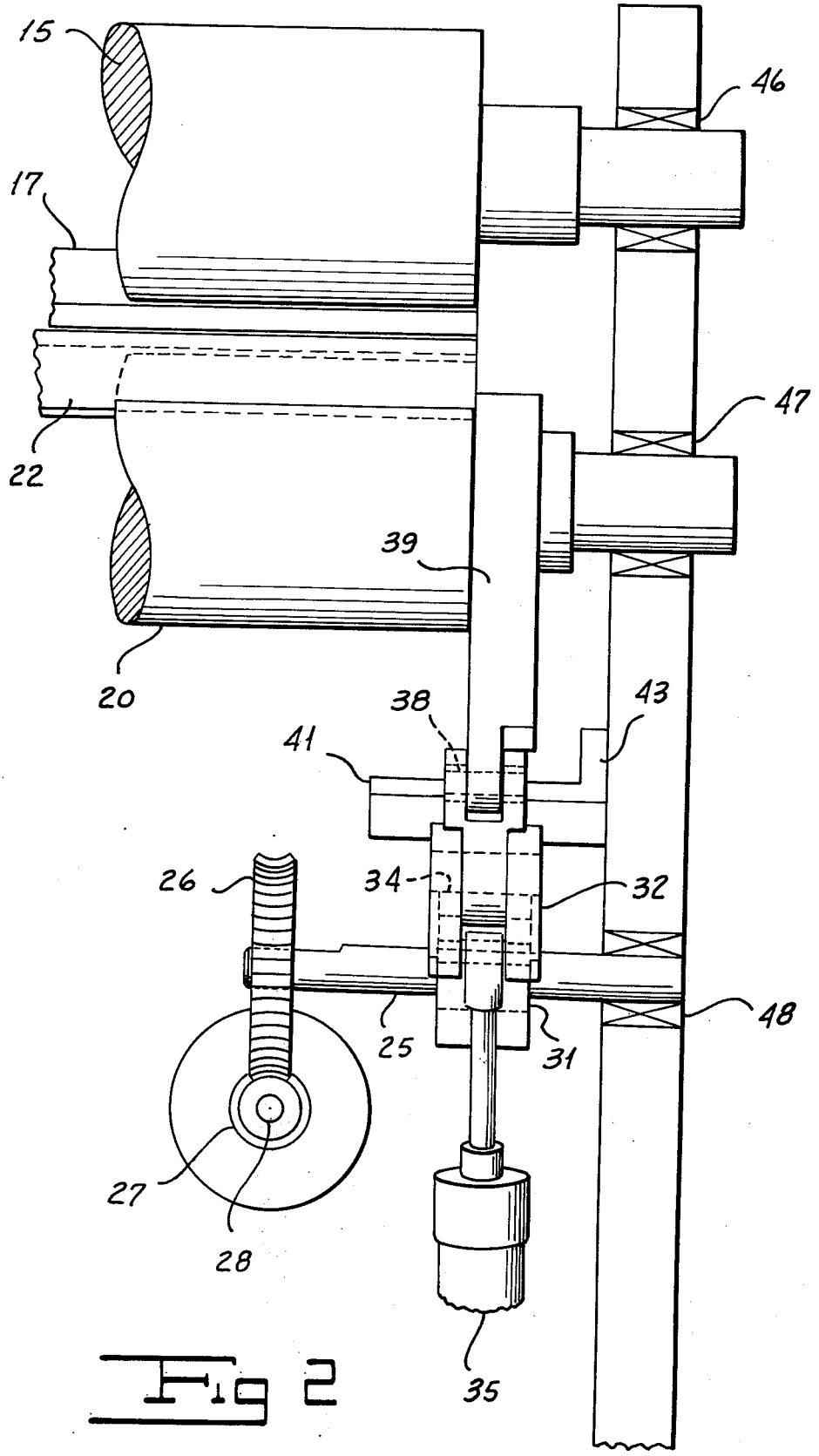
FIG. 2 is a view taken along line 2—2 of FIG. 1.

For purposes of brevity, only those parts necessary for understanding the invention are shown in the drawings. The various parts to be described are supported on two spaced frames, one being shown as 10. As shown in FIGS. 1 and 2, the web of material "W" to be cut enters from the right supported on an infeed guide plate 12. The web is normally fed to the cutter by a pair of feed rolls 13 and 14 driven by means, not shown, such as an electric motor.

Rotatably mounted in bearings 46 in the upper portion of the frame is rotating knife holder 15. Mounted on a machined flat on the holder by means of screws 16 is rotating knife 17. The position of the rotating knife on the holder 15 is set by adjusting screws 18 as will be discussed later. The rotating knife holder is preferably driven through a conventional infinitely variable transmission from the same means that drives the feed rollers 13 and 14. The speed ratios of the transmission are so selected that the speed of the cutting edge of the rotating knife 17 as the edge rotates through path 19 is always equal to or greater than the speed of the web "W" as determined by the speed of the feed rolls 13 and 14.

Below the rotating knife holder is bed knife holder 20 rotatably mounted in bearings 47 on the frames 10. Mounted on a machines flat on the holder by means of screws 21 is bed knife 22. Bed knife holder 20 is caused to rotate through a small arc, by means of a mechanism described below, from a position (position one) where bed knife 22 as shown in solid lines to a position (position 2) where the bed knife in dashed lines **22*a*. In position one the bed knife 22 is in juxtaposition with the rotating knife 17** each time the rotary knife passes the bed knife, causing a cut to be made in the traveling web "W". In position two, the bed knife is out of juxtaposition with the rotating knife so no cutting action will take place.

When cutting short length sheets, the bed knife is maintained in position one and a cut will be made at each revolution of the rotary knife. However, the longest sheet that can then be cut has a length about equal to the length of the rotating knife path 19, assuming the speed of the rotating knife edge is never less than the web speed. To cut longer sheets, the bed knife may be displaced intermittently to the second position for one, two, three or more revolutions of the rotary knife and then be displaced back to position one when desired to make a cut. In this matter sheets of any length may be cut.

It has been found that the most satisfactorily cutting of the aforementioned brittle materials can be obtained if the path 19 of the edge of the rotating knife intersects the theoretical path 23 of the edge of the bed knife as shown in FIG. 1. This configuration also allows the clearance between the knives to be readily adjusted by rotation of the bed knife holder when in position one. Clockwise rotation increases the clearance and counterclockwise rotation decreases the clearance. However, it will be noted that excessive counterclockwise rotation would result in contact between the knives with consequent chipping or other damage to the knives. Since the clearance adjustments are usually made while the cutter is operating, it is important that the mechanism for clearance adjustment be so designed that excessive counterclockwise movement of the bed knife holder cannot occur.

To restrict the counterclockwise movement of the bed knife holder, a toggle type adjustment means 24 is provided. Pivot shaft 25 is rotatably mounted in bearings 48 in the frames and on which shaft is keyed a fine pitch worm wheel 26. The worm wheel may be rotated by worm 27 keyed to shaft 28 rotatably mounted in bearings 29 affixed to the frame 10. Keyed to shaft 28 is handwheel 30 which preferably is the type that is fitted with an indicator means to allow repeatability of setting, such as the Tejax TM dial indicating handwheel manufactured by Tejax Engineering Corporation, Pawtucket, Rhode Island. Also keyed to pivot shaft 25 is eccentric 31 on which is pivoted first toggle arm 32. At its other end first toggle arm 32 is connected with second toggle arm 33 by means of pivot pin 34. First Toggle arm 32 is limitedly rotated by action of a fluid cylinder 35 which is pivotedly mounted on the frame by pivot pin 36 and which is connected to the first toggle arm by means of pivot pin 37. The second toggle arm 33 is pivotedly connected by means of pivot pin 38 to bed knife holder actuating arm 39 which at its other end is keyed to the bed knife holder 20.

The upward movement of the toggle arms 32 and 33 is limited by contact of a machined flat portion 42 on second toggle arm 33 with a stop generally indicated as 40 which comprises a block 41 firmly mounted on the frame 10 by bolting or welding a stop block 43 attached to block 41 and shims 44 between block 41 and stop block 43.

In operation, the bed knife is moved from the cutting position to the noncutting position by actuation of fluid cylinder 35 in the downward direction, thereby moving pivot pins 34 and 38 to positions **34*a* and 38*a* respectively. To move the bed knife into the cutting position, the fluid cylinder is actuated upwards until the flat portion 42 of second toggle arm 33 contacts the stop 40 and pivot pins 34 and 38 have returned to their original positions. The actuation of fluid cylinder 35** and consequent movement of the bed knife is controlled by electronic and electromechanical means which form no part of this invention.

The procedure for setting the correct relationship of the cutting knives is as follows: While the cutter is stopped, a measuring instrument such as a conventional dial indicator is temporarily mounted on the frame and bears against the bed knife holder actuating arm 39 as shown at 45. With fluid cylinder 35 actuated in the upward direction so that flat 42 is in contact with stop block 43, handwheel 30 is turned until eccentric 31 is in the position giving maximum movement of the first and second toggle arms toward pivot pin 38 as indicated by a maximum reading on the dial indicator 45. Shims 44 are now added or subtracted to again obtain a maximum reading on the dial indicator. These steps may now be repeated until the absolute maximum reading is obtained. At this time it is evident that the axes of shaft 25, eccentric 31, pivot pin 34 and pivot pin 38 will lie in one straight line.

The rotating knife is now adjusted by means of adjusting screws 18 to give the minimum desired clearance, typically 0.0005 to 0.001 inch, between it and the bed knife, and the rotating knife is then locked in place at which time the cutter is ready for operation.

The operator may now adjust the clearance between the knives to suit the thickness of the material to be run by turning the handwheel 30, which rotates the eccentric 31, which through the toggle arms 32 and 33 and bed knife holder actuating arm 39 results in an increase in the knife clearance.

It is to be noted that due to the straight line configuration of the eccentric and toggle arms at minimum clearance the knife clearance will decrease no matter in which direction the handwheel is turned, thus making it impossible for the operator to accidently make the knives contact each other.

Importantly, the clearance can be decreased to the minimum at any time without the danger of knife contact.

Further, by noting the setting on the indicating handwheel 30 which gives the most satisfactory cutting for each type and thickness of web material, the operator can later return to the proper settng for each of these materials and obtain the correct clearance.

The use of a toggle mechanism provides a very rigid locked position for the bed knife in the cutting position and at the same time requires only a moderate force by the fluid cylinder to actuate and lock the toggle. Therefore any wear on the flat 42 and stop block 43 due to impact is extremely minimal. It will be noted that any wear which might occur will result in an increased clearance between the cutter knives. Further, any appreciable wear will result in only a minor change in the clearance.

It will be understood that various changes in the details, materials and arrangements of parts which have been described and illustrated in order to explain the nature of the invention may be made by those skilled in the art within the principle and scope of the invention, as expressed in the appended claims.

What is claimed is:

1. A rotary cutter comprising:
a frame;
a rotary knife rotatably mounted to said frame;
a bed knife;
means displacably mounting said bed knife in said frame to travel in a path between an operative position adjacent said rotary knife in an inoperative position remote from said rotary knife;
extendable linkage means connected with said bed knife to define said operative position of said bed knife when said linkage means is disposed in fully extended position and said extendable linkage to contract during travel of said bed knife from said operative position;
actuating means connected to said extendable linkage intermediate the ends thereof to cause said bed knife to travel in said path between said operative and inoperative positions; and
means to adjust said extendable linkage means to said fully extended position to thereby adjust the operative position of said bed knife.

2. The rotary cutter according to claim 1 wherein said extendable linkage means connected with said bed knife to define said operative position of said bed knife when said linkage means is disposed in fully extended position comprise;
a plurality of arms pivotally connected in series relation;
the end of one of said plurality of arms connected with said means displacably mounting said bed knife; and
the ends of another of said plurality of arms connected with said means to adjust said extendable linkage means to enable adjustment of the angular position between said plurality of arms.

3. The rotary cutter according to claim 1 wherein said means to adjust said extendable linkage means to said fully extended position to thereby adjust the operative position of said bed knife comprise:
a pivot shaft;
means eccentrically pivotally connecting one end of said extendable linkage means to said pivot shaft;
means to rotate said pivot shaft to thereby cause movement of said pivotal connection of one end of said extendable means.

4. A rotary cutter comprising:
a frame;
a rotary knife rotatably mounted to said frame;
a bed knife;
means displacably mounting said bed knife in said frame to travel in a path between an operative position adjacent said rotary knife and an inoperative position remote from said rotary knife;
actuating means connected with said bed knife to cause said bed knife to travel in said path between said operative and inoperative positions;
extendable linkage means connected with said bed knife to define said operative position of said bed knife when said linkage means is disposed in fully extended position and to contract during travel of said bed knife from said operative position;
means to adjust said extendable linkage means to said fully extended position to thereby adjust the operative position of said bed knife;
said means to adjust said extendable linkage means to said fully extended position to thereby adjust the operative position of said knife comprise:
a pivot shaft;
means eccentrically pivotally connecting one end of said extendable linkage means to said pivot shaft;
means to rotate said pivot shaft to thereby cause movement of said pivotal connection of one end of said extendable means;
said means eccentrically pivotally connecting one end of said extendable linkage means to said pivot shaft comprise:
an eccentric fixedly mounted on said pivot shaft; and
said one end of said extendable linkage means pivotally connected to said eccentric.

5. A rotary cutter comprising:
a frame;
a rotary knife rotatably mounted to said frame;
a bed knife;
means displacably mounting said bed knife in said frame to travel in a path between an operative position adjacent said rotary knife and an inoperative position remote from said rotary knife;
actuating means connected with said bed knife to cause said bed knife to travel in said path between said operative and inoperative positions;
extendable linkage means connected with said bed knife to define said operative position of said bed knife when said linkage means is disposed in fully extended position and to contract during travel of said bed knife from said operative position;

means to adjust said extendable linkage means to said fully extended position to thereby adjust the operative position of said bed knife;

said means to adjust said extendable linkage means to said fully extended position to thereby adjust the operative position of said bed knife comprise:

a pivot shaft;

means eccentrically pivotally connecting one end of said extendable linkage means to said pivot shaft;

means to rotate said pivot shaft to thereby cause movement of said pivotal connection of one end of said extendable means;

said means to rotate said pivot shaft to thereby cause movement of said pivotal connection of one end of said extendable linkage gear means fixed to said pivot shaft comprise:

manually positionable gear means coacting with said gear means fixed to said pivot shaft to enable manual rotation of said pivot shaft.

6. The rotary cutter according to claim 1 further comprising stop means to prevent said extendable linkage means from extending beyond said fully extended position.

7. The rotary cutter according to claim 1 wherein:

said extendable linkage means connected with said bed knife to define said operative position of said bed knife when said linkage means disposed in fully extended position comprise:

a plurality of arms pivotally connected in series relation;

means connecting said plurality of arms to said means displacably mounting said bed knife; and said actuating means connected with said bed knife to cause said bed knife to travel in said path between said operative and inoperative positions comprise:

cylinder means connected to said plurality of arms pivotally connected in series relation, so that actuation of said cylinder means will pivot the arms of said extendable linkage means.

8. The rotary cutter according to claim 1 wherein:

said extendable linkage means connected with said bed knife to define said operative position of said bed knife when said linkage means disposed in fully extended position comprise:

a plurality of arms pivotally connected in series relation and said means displacably mounting said bed knife in said frame to travel in a path between an operative position adjacent said rotary knife and an inoperative position remote from said rotary knife comprise:

a bed knife holder rotatably mounted in said frame;

one end of said plurality of arms pivotally connected in series relation is fixedly connected to said bed knife holder so that pivoting of said plurality of pivotally connected arms will cause rotation of said bed knife with relation to said frame.

9. The rotary cutter according to claim 4 wherein said means to rotate said pivot shaft to thereby cause movement of said pivotal connection of one end of said extendable linkage gear means fixed to said pivot shaft comprise:

manually positionable gear means coacting with said pivot shaft to enable manual rotation of said pivot shaft.

10. A rotary cutter comprising:

a frame;

a rotary knife rotatably mounted to said frame;

a bed knife;

means displacably mounting said bed knife in said frame to travel in a path between an operative position adjacent said rotary knife and an inoperative position remote from said rotary knife;

actuating means connected with said bed knife to cause said bed knife to travel in said path between said operative and inoperative positions;

extendable linkage means connected with said bed knife to define said operative position of said bed knife when said linkage means is disposed in fully extended position and to contract during travel of said bed knife from said operative position;

means to adjust said extendable linkage means to said fully extended position to thereby adjust the operative position of said bed knife;

said extendable linkage means connected with said bed knife to define said operative position of said bed knife when said linkage means is disposed in fully extended position comprise:

a plurality of arms pivotally connected in series relation;

the end of one said plurality of arms connected with said means displacably mounting said bed knife; and the end of another said plurality of arms connected with said means to adjust said extendable linkage means to enable adjustment of the angular position between said plurality of arms;

said means to adjust said extendable linkage means to said fully extended position to thereby adjust the operative position of said bed knife comprise:

a pivot shaft;

means eccentrically pivotally connecting one end of said extendable linkage means to said pivot shaft;

means to rotate said pivot shaft to thereby cause movement of said pivotal connection of one end of said extendable means;

said means eccentrically pivotally connecting one end of said extendable linkage means to said pivot shaft comprise:

an eccentric fixedly mounted on said pivot shaft;

said one end of said extendable linkage means pivotally connected to said eccentric;

said means to rotate said pivot shaft to thereby cause movement of said pivotal connection of one end of said extendable linkage gear means fixed to said pivot shaft comprise:

manually positionable gear means coacting with said gear means fixed to said pivot shaft to enable manual rotation of said pivot shaft;

said actuating means connected with said bed knife to cause said bed knife to travel in said path between said operative and inoperative positions comprise:

cylinder means connected to said plurality of arms pivotally connected in series relation, so that actuation of said cylinder means will pivot the arms of said extendable linkage means;

said means displacably mounting said bed knife in said frame to travel in a path between an operative position adjacent said rotary knife and an inoperative position remote from said rotary knife compromise:

a bed knife holder rotatably mounted in said frame;

one end of said plurality of arms pivotally connected in series relation is fixedly connected to said bed knife holder so that pivoting of said plurality of pivotally connected arms will cause rotation of said bed knife with relation to said frame; and further comprising stop means to prevent said extendable means from extending beyond fully extended position.

* * * * *